US005769710A

United States Patent [19]

Kim

[11] Patent Number: 5,769,710

[45] Date of Patent: Jun. 23, 1998

[54] DISCHARGE OUTLET OPENING AND CLOSING APPARATUS OF AIR CONDITIONER

[75] Inventor: Do-Yeon Kim, Incheon, Rep. of Korea

[73] Assignee: Samsung Electronics Co., Ltd., Suwon, Rep. of Korea

[21] Appl. No.: 741,358

[22] Filed: Oct. 30, 1996

[30] Foreign Application Priority Data

Oct. 31, 1995 [KR] Rep. of Korea ..... 95-38847
Oct. 31, 1995 [KR] Rep. of Korea ..... 95-38849

[51] Int. Cl.[6] ..... F24F 13/12

[52] U.S. Cl. ..... 454/324; 454/321

[58] Field of Search ..... 454/304, 315, 454/319, 320, 321, 324, 334, 370

[56] References Cited

U.S. PATENT DOCUMENTS 1,064,573 6/1913 Ulrich ..... 454/324 X 5,461,875 10/1995 Lee et al. ..... 454/324 X

*Primary Examiner*—Harold Joyce

*Attorney, Agent, or Firm*—Burns, Doane, Swecker & Mathis, L.L.P.

[57] ABSTRACT

An air conditioner includes an outlet for discharging cool air into a room. The outlet can be closed by a vertically movable shutter. The shutter carries two vertical racks which are selectively engageable by a horizontally shiftable, motor-driven pinion. The pinion, which is rotated in only one direction, displaces the shutter into an outlet closing position when the pinion engages one of the racks, and displaces the shutter in an opposite direction when the pinion engages the other rack. Horizontal shifting of the pinion can be performed by tripping jaws which are formed on the racks and are engageable with the pinion, or by a separate device such as a fluid-actuated cylinder.

7 Claims, 10 Drawing Sheets

DISCHARGE OUTLET OPENING AND CLOSING APPARATUS OF AIR CONDITIONER

BACKGROUND OF THE INVENTION

1. Field of the Invention

The present invention relates to an air conditioner, and more particularly to a discharge outlet opening and closing apparatus of an air conditioner by which foreign objects and the like are prevented from entering thereinto when it is stopped.

2. Description of the Prior Art

An air conditioner according to the prior art is coupled with a front panel 20 at a central front surface of a cabinet 10 having a rear side wall and two lateral walls, as illustrated in FIG. 1.

The front panel 20 is provided with a control unit 30 for controlling the air conditioner, and the cabinet 10 is respectively formed at a lower end and an upper end of the front surface thereof with a suction inlet 40 and a discharge outlet 50 for sucking and discharging the air outside of the air conditioner.

The suction inlet 40 is disposed with a suction grill 41 to form an external appearance and at the same time, to support a filter member (not shown).

The discharge outlet 50 is disposed with a plurality of wind direction vertical control fins 51 and wind direction horizontal control fins 52 arranged at predetermined spacings in order to control the direction of cool wind supplied into a room through the discharge outlet 50.

However, there is a problem in the air conditioner thus constructed according to the prior art, in that foreign objects and the like can be infused into the air conditioner through the discharge outlet 50 when the air conditioner is turned off, resulting in a frequent cleaning of an interior of the air conditioner.

There is another problem in that the foreign objects and the like infused into the air conditioner are discharged into the room simultaneously at an initial operation of the air conditioner through the discharge outlet 50, to pollute room air, to decrease a cleanliness thereof and to thereby render a user with an unpleasant feeling.

Moreover, there is still another problem in the air conditioner according to the prior art in that a whole body of the air conditioner should be covered by a vinyl cover so as to prevent the foreign objects and the like from entering thereinto when the air conditioner is not used for a long time, to thereby detract from the external appearance thereof.

In consideration of the aforementional problems, a discharge outlet opening and closing apparatus of an air conditioner is disclosed by the present applicant in Korean utility model application No.95-13669 (filed on Jun. 16, 1995).

In other words, a discharge outlet opening and closing apparatus of an air conditioner is coupled with a cabinet, as illustrated in FIGS. 2 and 3, and is supported by support means 60.

The support means 60 is carrier a forward and reverse rotating motor 70 for receiving an electric power according to a control signal of a control unit 30 to thereby be driven.

The motor 70 is coupled with a pinion 80 disposed at on motor axle 71 thereof in order to receive a power from the motor 70 and to rotatively be moved.

Furthermore, the pinion 80 is meshed with a rack 90 for receiving the rotary movement of the pinion to thereby perform a linear movement.

The rack 90 is coupled to shutter means 100 for being simultaneously vertically moved with the rack 90 and for being a guide by the support means 60 to thereby open and close the discharge outlet 50.

The support means 60 is provided with a plurality of position detecting sensors 110 for detecting the vertical movement of the shutter means 100.

At this time, the support means 60 is provided with a support member 61 having a through hole 61*a* so as to support the motor 70 at a predetermined position.

The support means 61 is symmetrically and fixedly coupled at both ends thereof to a guide member 62 so that the plurality of wind direction vertical control fins 51 and wind direction horizontal control fms 52 can be supportively guided in a space of the discharge outlet 50 formed at an upper surface of the support member 61 and at the same time, the shutter means 100 can be vertically moved along a front surface of the support member 61 to cause the discharge outlet 50 to be closed and opened.

The support member 61 carries a guide roller 63 so as to prevent the meshed pinion 80 and rack from being dislodged the same time, to cause the rack 90 to receive the power from the pinion 80 and to smoothly perform a vertically linear movement.

The pinion 80 is freely and fixedly coupled to the motor axle 71 of the motor 70 so as to receive a driving force of the motor 70 and to perform a rotary movement.

The rack 90 is meshed with the pinion 80 and at the same time, is supported by the guide roller 63.

The rack 90 is fixedly coupled at an upper predetermined position of the shutter means by a plurality of fastening screws 91.

The shutter means 100 includes a shutter member 101 for covering a discharge area of the discharge outlet 50, a roller assembly 102 at both upper and lower ends of the shutter member 101 so as to linearly contact an inner surface of a channel unit 62*a* formed on the guide member 62 perform a rolling movement and to vertically therein, and a position detecting protruder 103 disposed at a lower end side of the shutter member 101 so as to cooperate with the plurality of position detecting sensors 110 when the shutter 101 is vertically moved.

However, there is a problem in the discharge outlet opening and closing apparatus of an air conditioner thus constructed according to the prior art, in that it is constructed such that, a pinion 80 and a rack 90 are activated according to the power transmitted from the forward and reverse rotating motor 70 to vertically move the shutter member 100 and to open or close a discharge space of the discharge outlet 50, so that a manufacturing cost thereof is increased due to use of the forward and reverse rotating motor 70.

SUMMARY OF THE INVENTION

Accordingly, the present invention is disclosed to solve the aforementioned problems and it is an object of the present invention to provide a discharge outlet opening and closing apparatus of an air conditioner adapted to use a single direction rotary motor to thereby reduce a manufacturing cost.

It is another object of the present invention to provide a discharge outlet opening and closing apparatus adapted to enable a shutter member to vertically move according to a pinion and a rack to thereby prevent the shutter member from being dislodged and swayed during vertical movement of the shutter member and to enable the shutter member to vertically move to an accurate position according to a control of a motor.

In accordance with one object of the present invention, there is provided a discharge outlet opening and closing apparatus of an air conditioner so employing shutter driving means so that shutter means can be moved vertically to close or open a discharge outlet, wherein the shutter driving means comprises:

a motor adapted to be driven in a single direction;

a pinion for receiving a power from the motor to thereby be rotated in a single direction and to be horizontally dislodged; and a first rack and a second rack for receiving a turning effect from the pinion to thereby perform a linear movement downwardly for downwardly moving the shutter means to thereby open a discharge outlet or for receiving a turning effect from the pinion to thereby perform a linear movement upwardly for upwardly moving the shutter means to thereby close the discharge outlet.

In accordance with another object of the present invention, there is provided a discharge outlet opening and closing apparatus of an air conditioner employing shutter driving means such that shutter means can be moved vertically to close and open a discharge outlet, wherein the shutter driving means comprises:

a rotary member coupled to support means for rotation;

a cylinder for horizontally moving the rotary member by way of hydraulic action;

a motor for being driven in a single direction and connected the rotary member;

a pinion for receiving the power from the motor to thereby be rotated and for being horizontally shifted with the motor; and shutter driving means employing a rack member for being meshed with or separated from the pinion while receiving the turning effect of the pinion to perform a vertical linear movement so that the shutter means can be raised or lowered.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF PREFERRED EMBODIMENTS OF THE INVENTION

Figure 1:
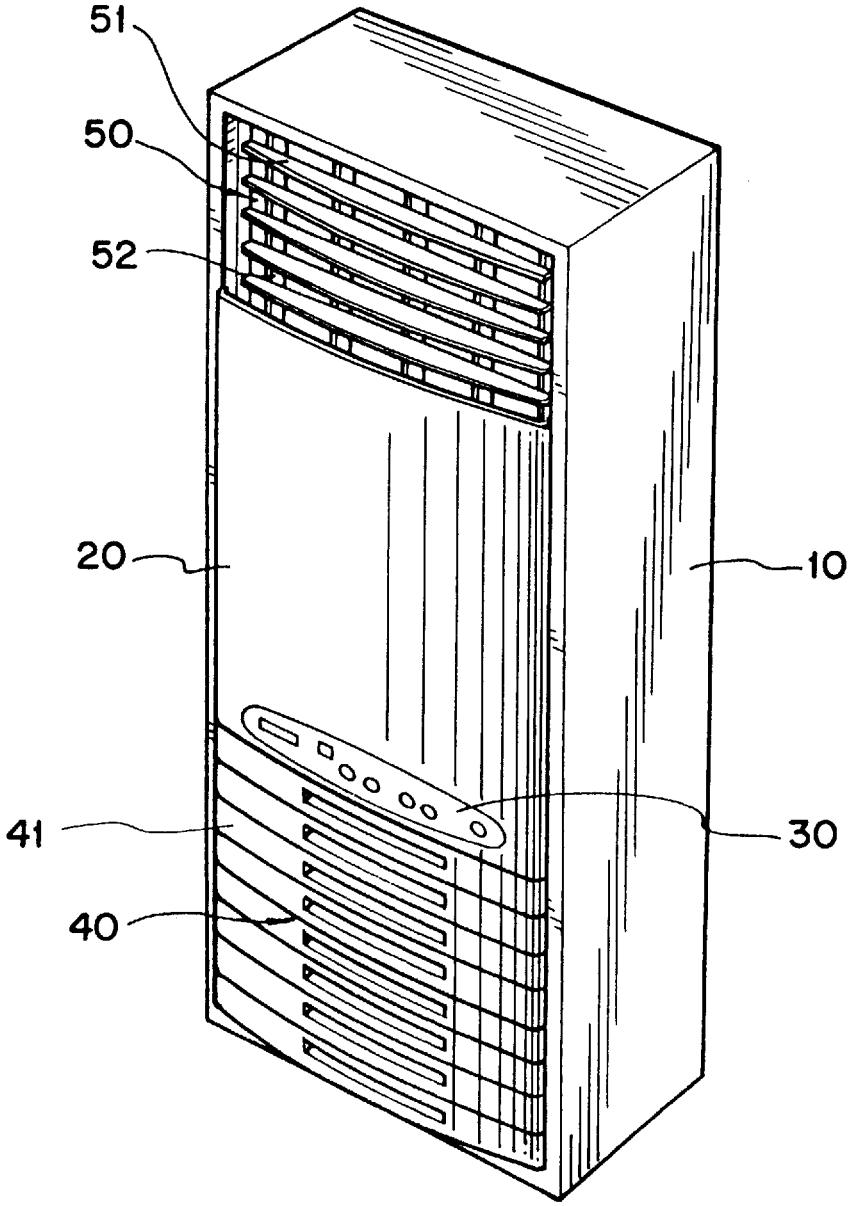
FIG. 1 (PRIOR ART)
FIG. 1 is a perspective view for illustrating an air conditioner according to one embodiment of the prior art.
Figure 2:
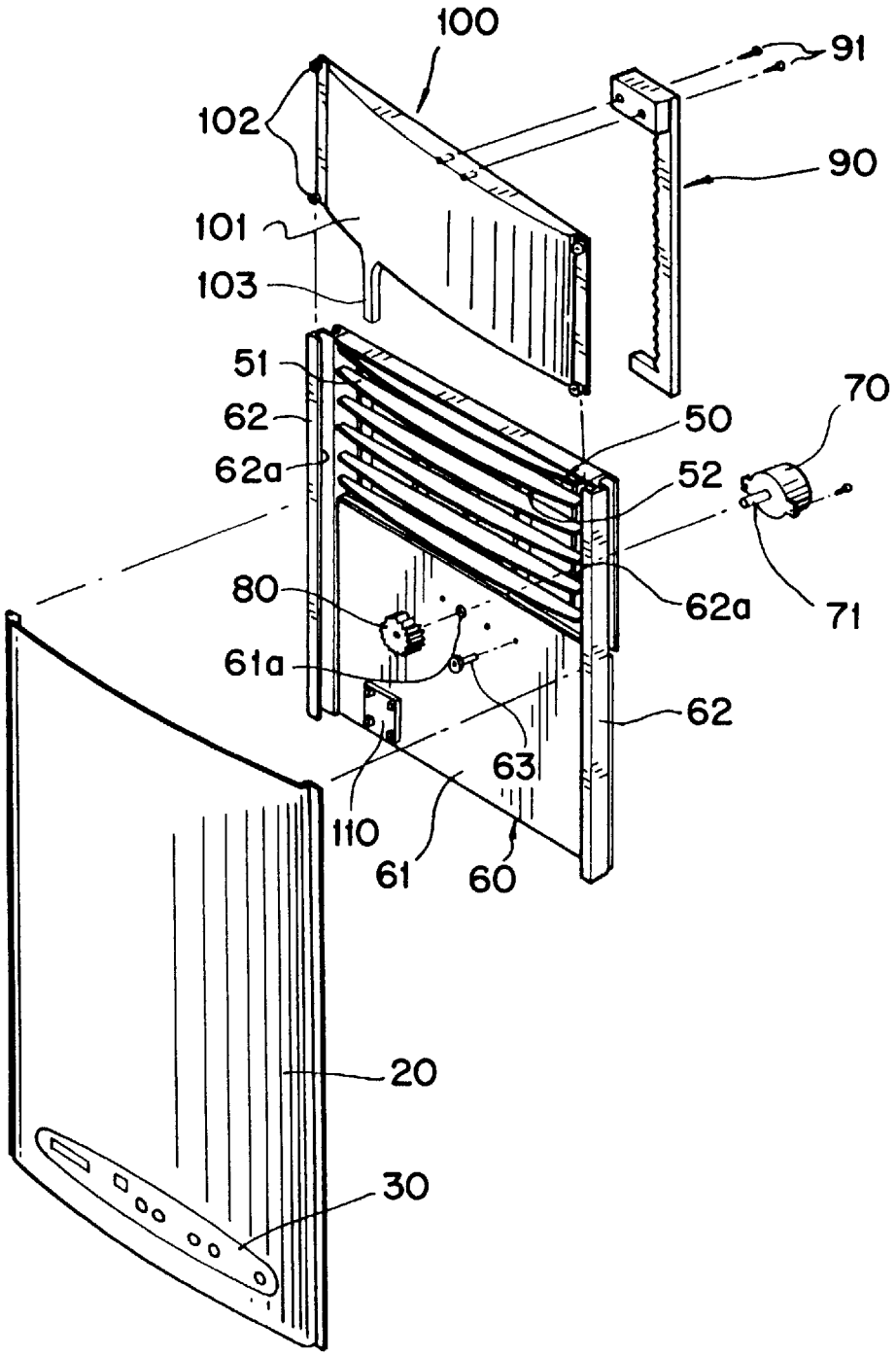
FIG. 2 (PRIOR ART)
FIG. 2 is an exploded perspective view for illustrating a discharge outlet opening and closing apparatus according to another embodiment of the prior art.
Figure 3:
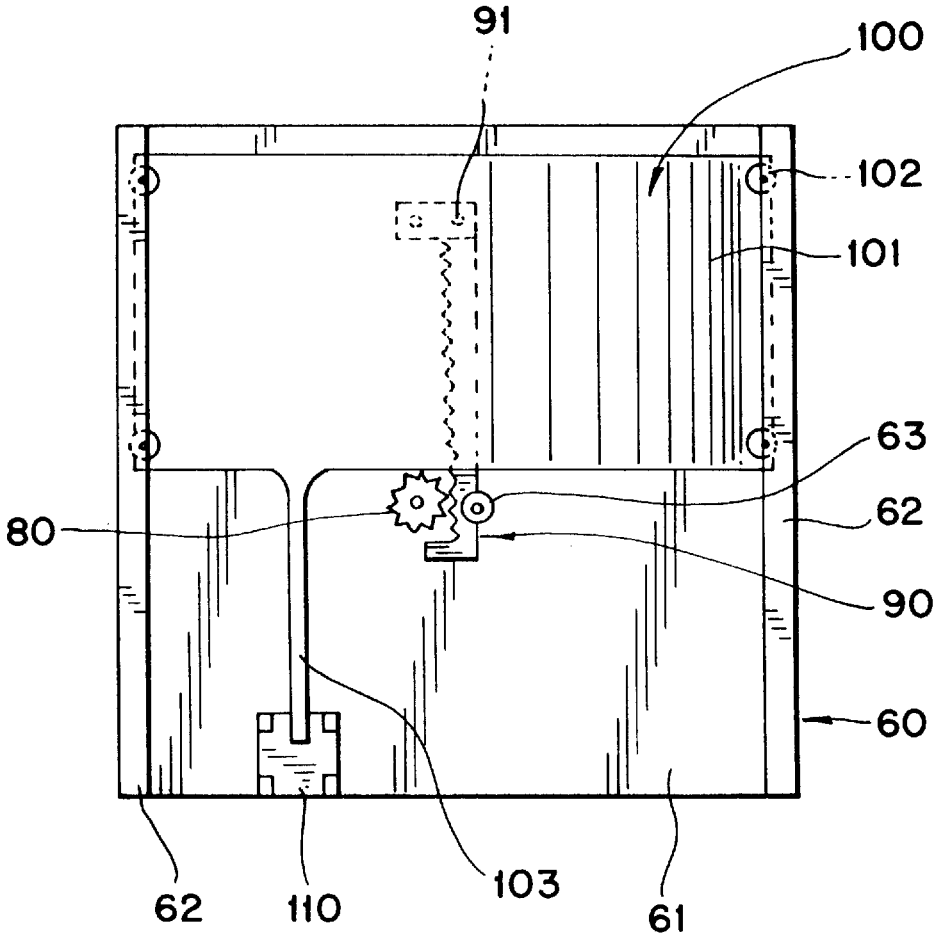
FIG. 3 (PRIOR ART)
FIG. 3 is an assembled front view for illustrating a discharge outlet opening and closing apparatus according to the prior art.

Now, a discharge outlet opening and closing apparatus of an air conditioner according to the preferred embodiments of the present invention will be described in detail with reference to the accompanying drawings.

Throughout the drawings, like reference numerals and symbols are used for designation of like or equivalent parts or portions for simplicity of illustration and explanation, and detailed description thereto will be omitted.

Figure 4:
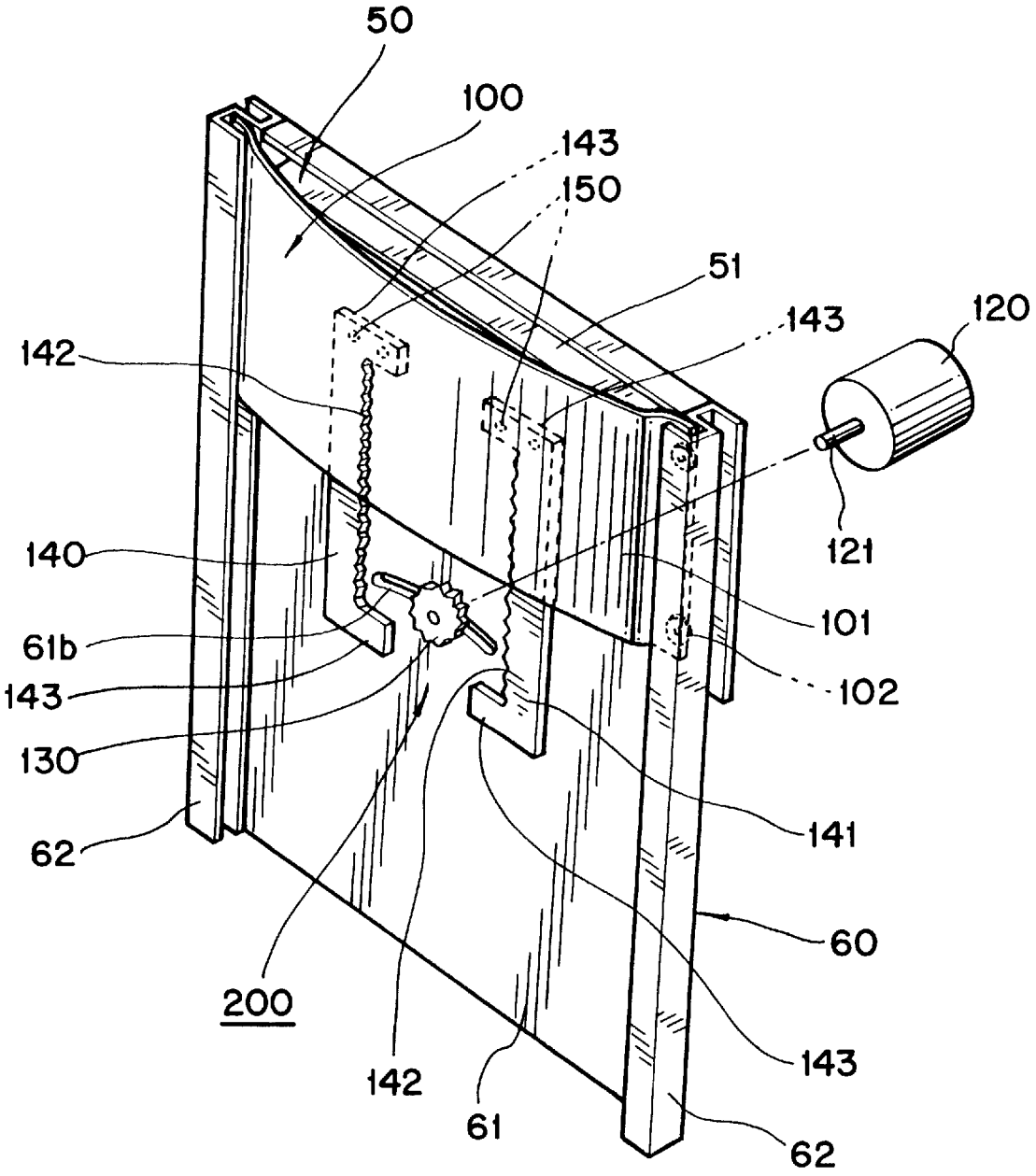
FIG. 4 is an exploded perspective view for illustrating a discharge outlet opening and closing apparatus according to a first embodiment of to the present invention.

As illustrated in FIG. 4, reference numeral 200 is shutter driving means for vertically moving shutter means supported to support a conventional means 60 so as to close or open the discharge outlet 50.

Figure 5:
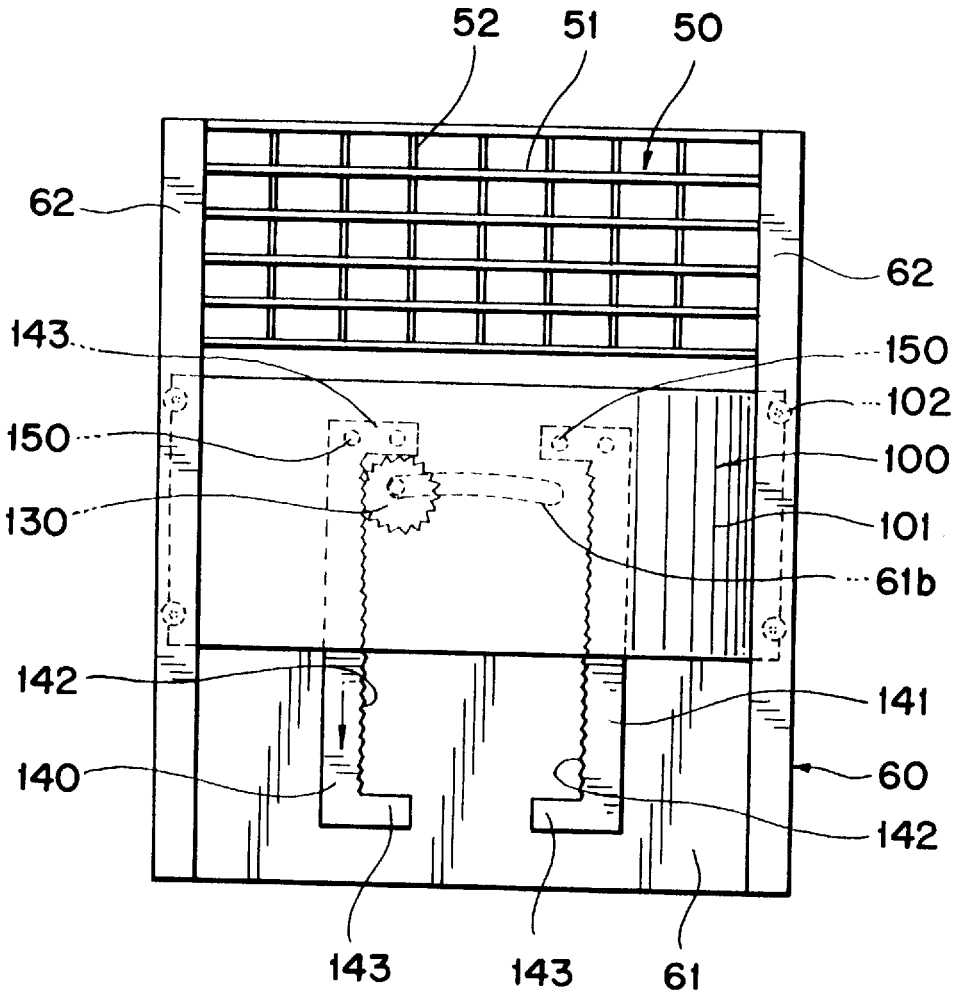
FIG. 5 is a front view of principal parts for illustrating an opened state of a discharge outlet according to a shutter member of the FIG. 4.
Figure 6:
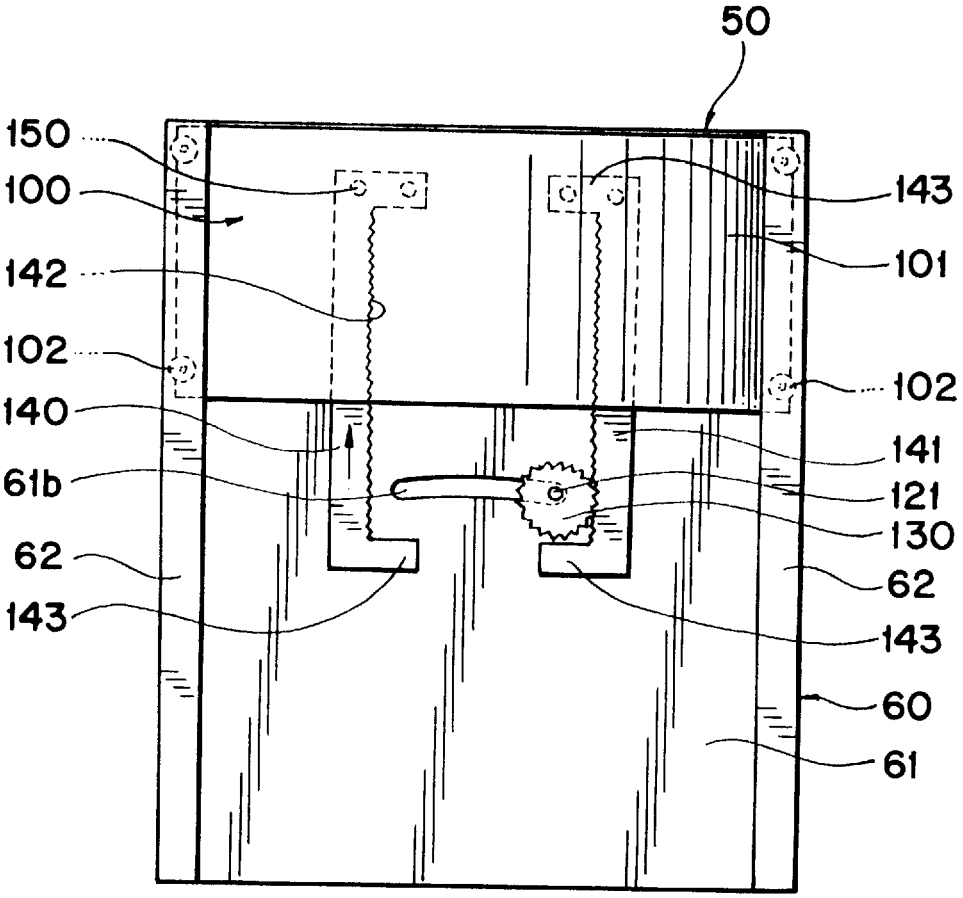
FIG. 6 is a front view of principal parts for illustrating a closed state of the shutter member FIG. 4.

In other words, the shutter driving means 200 includes, as illustrated in FIGS. 4, 5 and 6, a motor 120 disposed at support member 61 so as to be driven in a single direction according to a control signal of a control unit 30 (see FIG. 1), a pinion 130 provided at the support member 61 so as to be rotated the motor 120 in a single direction, and a first rack 140 and a second rack 141 mounted on the shutter member 101 at a predetermined spacing so as to be meshed with the pinion 130, so that the racks can be vertically moved by of the pinion 130 to simultaneously move the shutter means 100 vertically.

At this time, the support member 61 is horizontally formed at a central upper end thereof with an oblong hole 61b so that the pinion 130 can be horizontally moved to thereby be meshed with the first rack 140 or the second rack 141.

The pinion 130 is fixedly secured to a motor axle 121 of the motor 120 which protrudes through the oblong hole 61*b* from a rear side of the support member 61.

The first rack 140 is vertically positioned at one side of a rear surface of the shutter member 101, as illustrated in FIGS. 5 and 6 and an inner surface thereof is meshed with the pinion 130 or is out of mesh.

The second rack 141 is vertically positioned at the other side of the rear surface of the shutter member 101 and an inner surface thereof is symmetrically disposed at a predetermined spacing from the first rack so as to be meshed with or to be out of mesh with the pinion 130.

In other words, the first and second racks 140 and 141 are positioned at the same height at the rear surface of the shutter member 130 and upper ends thereof are respectively fastened to the shutter member 130 through the medium of a plurality of fastening screws 150.

Furthermore, the first and second racks 140 and 141 are symmetrically formed at inner vertical surfaces thereof with screw threads 142 to be meshed with the pinion 130, and the racks 140 and 141 are inwardly symmetrically and protrudingly formed with tripping jaws 143 so as to engage and the pinion 130 inwardly.

Next, an operational effect of the discharge outlet opening and closing apparatus of an air conditioner according to the embodiment of the present invention thus constructed will be described.

When a user manipulates a control unit 30 or a remote control unit (not shown) disposed on a front panel 20 in order to open the discharge outlet 50 when the air conditioner is under operation, the motor 120 receives the power and is driven in a single direction to thereby rotate the pinion 130 in a single direction only.

The first rack 140 meshed with the pinion 130 serves to change a rotary movement of the pinion 130 to a linear movement to thereafter be moved downwardly and at the same time to downwardly move the shutter member 100 coupled to one end thereof to open the outlet 50 (see FIG. 5);

At this time, the pinion 130 is automatically moved out of mesh with the screw threads 142 of the first rack 140 when the pinion is hit by the tripping jaw 143 formed at an upper end of the first rack 140.

The pinion 130 is guided by the oblong hole 61*b* to thereafter be moved toward the second rack 141 and to be meshed with the screw threads 142 of the second rack 141 and simultaneously to be stopped of rotation.

The cool wind heat-exchanged in the air conditioner is discharged indoors through the discharge outlet 50 to thereby cool a room.

Meanwhile, when the control unit 30 or a remote control unit (not shown) on the front panel 20 is manipulated to close the discharge outlet 50, the motor begins rotating the pinion 130 in the single direction.

The second rack 141 meshed into the pinion 130 changes the rotary movement of the pinion 130 to a linear movement and is moved upwards and simultaneously moves upwards the shutter member 101 of the shutter means 100 coupled to one end thereof.

At this time, the pinion 130 becomes automatically moved out of mesh with the screw threads 142 of the second rack 141, when the pin hits the tripping jaw 143 protruding underneath the second rack 141 while the second rack 141 is moved upwards, and then the pinion 130 is guide by the oblong hole 61*b* to thereafter be moved to the first rack 140 and simultaneously stopped of rotation.

The shutter member 101 thus serves to close the discharge outlet 50 as illustrated in FIG. 6.

Consequently, foreign objects are prevented from entering into the air conditioner and at the same time, a good external appearance of the discharge outlet 50 can be maintained when the air conditioner is not used.

Furthermore, when the air conditioner is activated after the discharge outlet 50 is and re-opened, fresh air containing no foreign objects and the like is infused indoors through the discharge outlet 50, so that cleanliness of the room air can be increased and pleasant atmosphere can be provided to the user at all times.

Although the present embodiment has described a discharge outlet opening and closing apparatus of an air conditioner whereby a shutter means 100 is vertically moved to thereby open and close the discharge outlet 50 according to activation of motor 120, the foregoing description is not to be taken as limiting thereto.

By way of example, it should be noted that either the opening or the closing of the discharge outlet 50 can be performed manually within the scope of this invention.

As mentioned above, there is an advantage in that the manufacturing cost can be reduced by the use of the single direction rotary motor.

Now, a discharge outlet opening and closing apparatus according to another embodiment of the present invention will be described in detail with reference to the accompanying drawings (FIGS. 7, 8, 9 and 10).

Figure 7:
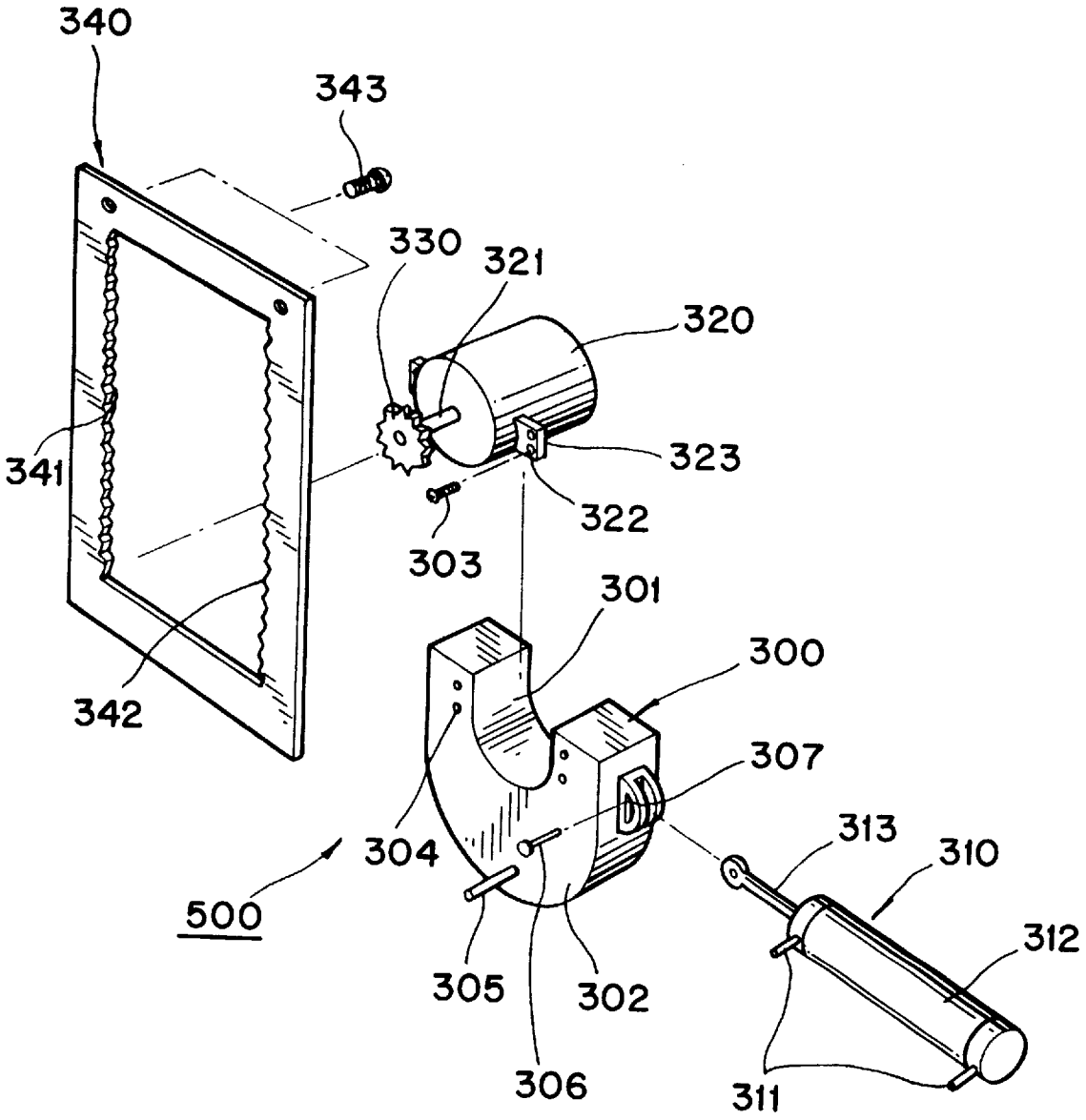
FIG. 7 is an exploded perspective view for illustrating shutter driving means according to a second embodiment of the present invention.

As illustrated in FIG. 7, reference numeral 500 represents shutter driving means for vertically moving shutter means 290 (see FIG. 9) supported to a support means 61 so as to open or close the discharge outlet 50.

Figure 8:
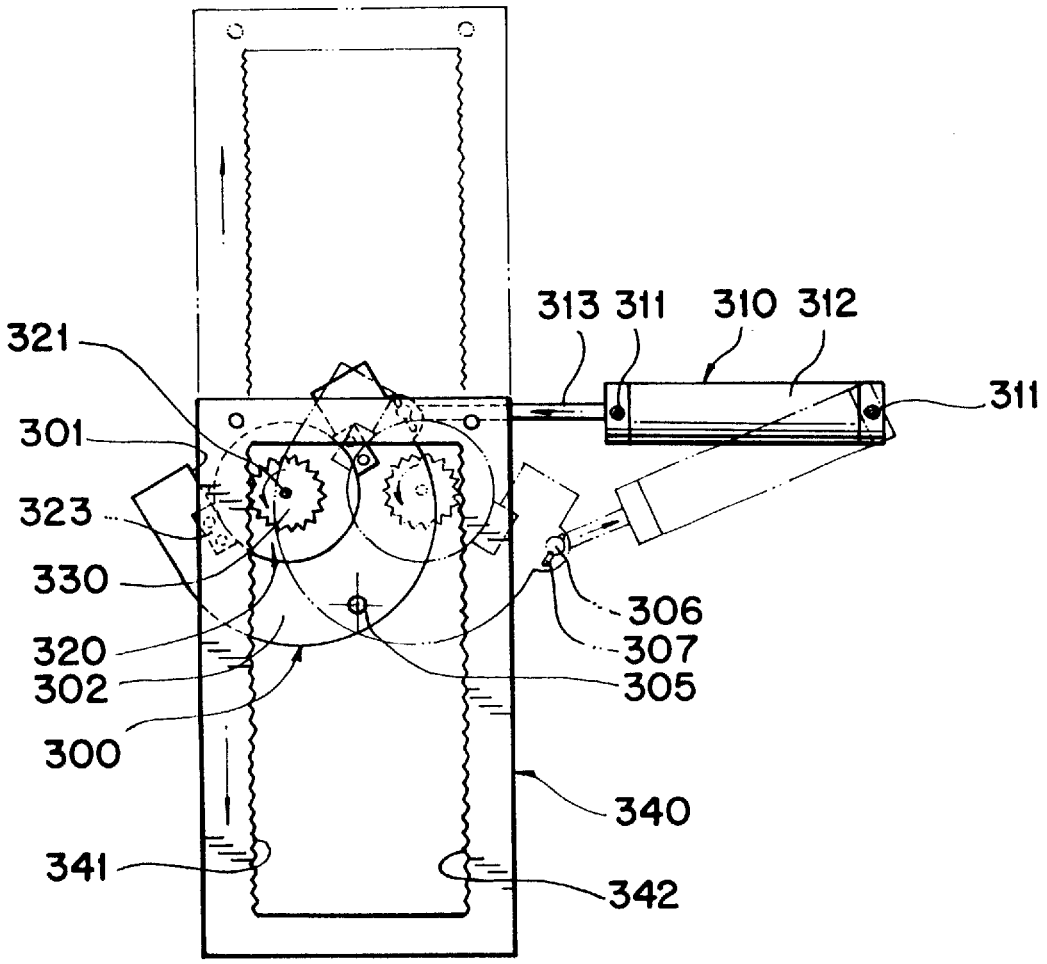
FIG. 8 is a front view for illustrating the exploded parts of FIG. 7 in an assembled state.

The shutter driving means 500 includes, as illustrated in FIGS. 7 and 8, a rotary member 300 hinge-coupled to the support means 61 (see FIG. 9) for rotation about a horizontal axis of a hinge pin 305 ; a cylinder 310 disposed at the support member 61 so as to rotate the rotary member 300 according to hydraulic action, a motor 320 disposed an the rotary member 300 so as to be driven in a single direction according to a control signal from control unit 30 (see FIG. 1), a pinion 330 coupled to a motor axle 321 of the motor 320 so as to be moved along with the motor 320 and rotated according to a power received from the motor 320, and a rack member 340 disposed on the shutter means 290 for being meshed into the pinion 330 so as to be vertically moved by the pinion 330 and simultaneously raise or lower the shutter means 290.

Figure 9:
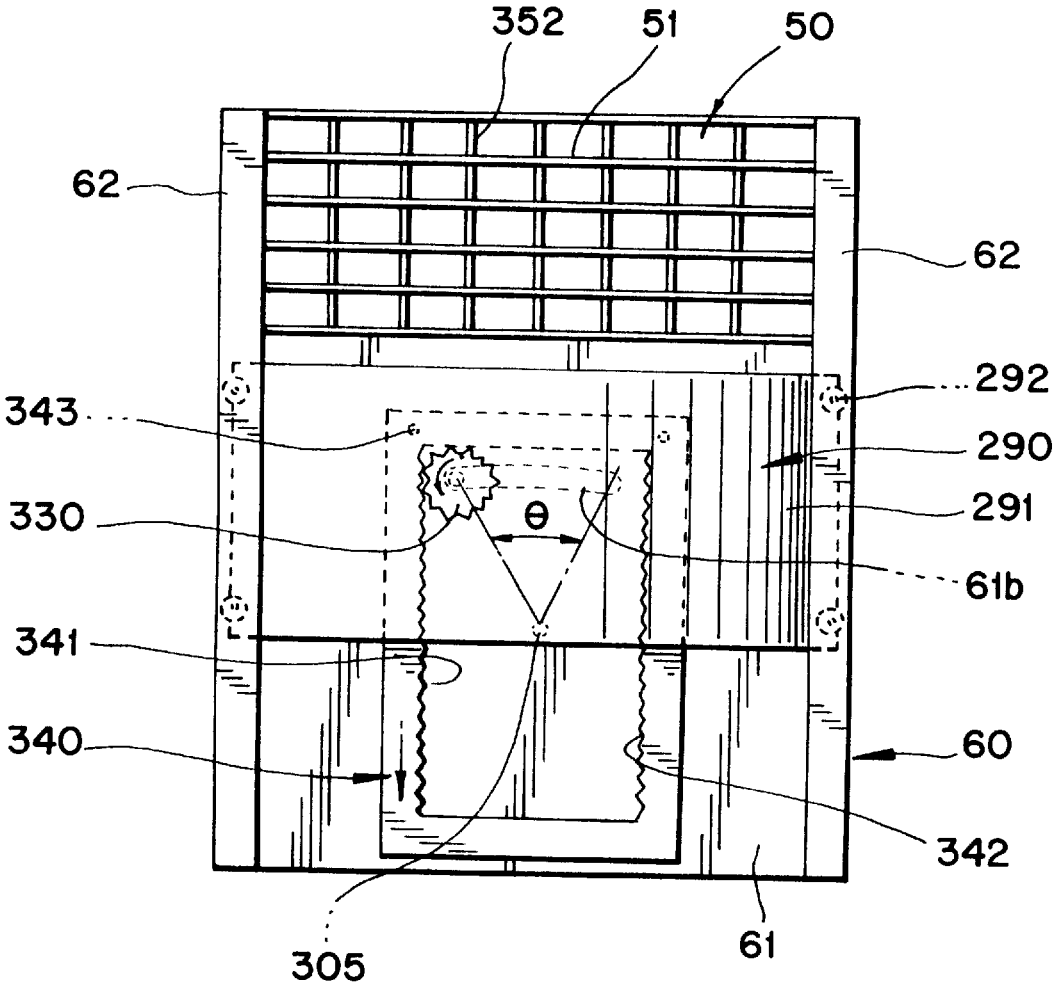
FIG. 9 is as front view of principal parts for illustrating an opened state of the discharge outlet according to the shutter member of the FIG. 7.
Figure 10:
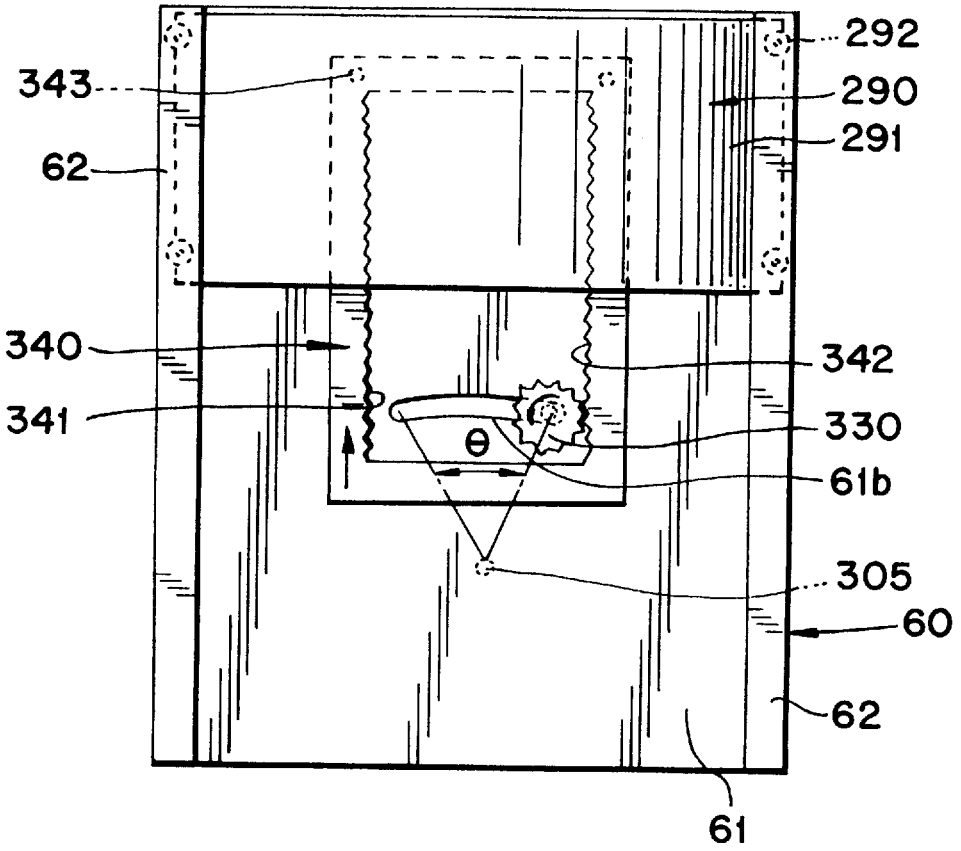
FIG. 10 is a front view of principal parts for illustrating a closed state of the discharge outlet according to the shutter member of the FIG. 7.

The support member 61 is centrally and horizontally formed with an oblong hole 61*b*, as illustrated in FIG. 9, so as to guide the pinion 330 when the latter is horizontally moved.

The rotary member 300 includes a U-shaped body 302 having a recess 301 so as to receive the motor 302 a plurality of first screw holes 304 formed at both sides of the body 302 so that the motor 320 can be fixedly coupled to the body 302 through the media of fastening screws 303, hinge axle 305 protruding at a front lower central area of the body 302 so that the body 302 can be hinge-coupled to a rear surface of the support member 61 to thereafter be rotated, and a connecting unit 307 where the cylinder 310 is hinge-coupled to one side of the body by a hinge pin 306 capable vertical movement so that the body 302 can be horizontally rotated and stopped by hydraulic action of the cylinder 310.

The cylinder 301 includes a cylinder tube 312 for having two ports 311 through which oil pressure c an be infused and discharged according to the control signal to the control unit 30 and simultaneously for being pivotably-mounted to a side of a rear surface of the support member 61, and a cylinder rod 313 for being and linearly moved by hydraulic action generated in the cylinder tube 312 for rotating the rotary member 300.

The motor 320 is integrally and protrudingly formed with fixing pieces 323 having holes 322 corresponding to the plurality of first holes 304 formed in the body 302 of the rotary member 300 at both peripheral sides thereof.

The pinion 330 is fixedly coupled to the motor axle 321 of the motor 320 forwardly protruded through the oblong hole 61*b* at a rear side of the support member 61.

The rack member 340 has a rectangular shape with a central portion thereof being opened, and is symmetrically formed at inner left and right sides thereof with a first rack 341 and a second rack 342 so that the pinion 330 can be selectively meshed therewith.

In other words, when the first rack 341 is meshed with the pinion 330, the second rack 342 becomes out of mesh with the pinion 330, whereas, when the second rack 342 is meshed with the pinion 330 the first rack 341 gets out of mesh with the pinion 330.

Furthermore, the rack member 340 is securely coupled by a plurality of fastening screws 343 to a rear surface of the shutter member 291.

Next, an operational effect of the discharge outlet opening and closing apparatus of an air conditioner according to the second embodiment of the present invention thus constructed will be described.

When the control unit 30 or a remote control unit (not shown)) disposed at the front panel 20 is manipulated in order to open the discharge outlet in a state where the air conditioner is under operation, the motor 320 is applied with the power to thereafter be driven in one single direction, so that the pinion 330 coupled to the motor axle 321 thereof can be rotated in a single direction.

The first rack 341 meshed into the pinion 330 serves to convert a rotary movement of the pinion 330 to a linear movement, as illustrated in FIG. 9, to thereafter be moved downward.

Simultaneously, the shutter member 291 of the shutter means 290 coupled to one end thereof is moved downwards.

The shutter member 291 has roller members 292 respectively mounted at lower and upper ends thereof which smoothly move downwards in line contact with channels unit 62*a* formed in the guide member 62 of the support means 60, thereby opening the discharge outlet 50, and the cool wind heat-exchanged in the air conditioner through the discharge outlet 50 is discharged indoors to thereby lower room temperature.

At this time, when an upper end of the first rack 341 reaches the pinion 330, the motor is stopped of its activation according to revolution-per-minute RPM control of the motor 320, and simultaneously, the cylinder 300 is retracted so that the rotary member 300 is swung to the right side.

At this time, the pinion 330 is guided by the oblong hole 61*b*.

On the other hand, when the control unit 30 or the remote control unit (not shown) disposed at the front panel 20 is manipulated in order to close the discharge outlet 50, the motor 320 is driven in the single direction to continuously rotate the pinion 330 in the single direction.

The second rack 342 meshed into the pinion 330 serves to convert a rotary movement of the pinion 330 to a linear movement. The rack 342 is moved upwards to close the outlet 50 and simultaneously moves the shutter member 291 upwards.

At this time, when a lower end of the second rack 342 reaches the pinion 330, the motor 320 is stopped of its operation by the RPM control of the motor 320 and simultaneously the cylinder 300 is extented;

Still other variations and modifications are possible such as where the discharge outlet 50 is opened or closed by way of manual vertical manipulation of the shutter means 290 without departing from the spirit and the scope of the present invention.

As apparent from the foregoing, there is an advantage in the discharge outlet opening and closing apparatus of an air conditioner according to the present invention, in that a pinion is rotated by a single-direction motor, and a cylinder horizontally moves the motor to selectively be meshed with a first rack and a second rack formed in the left and right sides of a rack member to vertically move a shutter member to close or open the discharge outlet, so that break-away or swaying of the shutter member can be prevented during vertical movement thereof and the shutter member can be vertically moved to an accurate position just by way of RPM control of the single-direction motor without recourse to a shutter position detecting sensor.

What is claimed is:

1. An air conditioner comprising:

a housing forming a cool air outlet;

an outlet closing mechanism mounted to the housing and including:

a shutter movable vertically between outlet-pen and outlet-closed positions;

a motor having a drive axle rotatable in only one direction of rotation;

a pinion fixed to the axle to be rotated thereby in the one direction of rotation; and a vertical rack structure connected to the shutter the rack structure being engageable with the pinion and driven by the pinion to at least one of the outlet-open and outlet-closed positions, wherein the rack structure comprises horizontally spaced first and second vertical racks, the pinion being shiftable into mesh with only the first rack for moving the shutter in one vertical direction into the outlet-open position in response to rotation of the pinion in the one direction of rotation, the pinion being shiftable out of mesh with the first rack and into mesh with the second rack for moving the shutter in another vertical direction opposite the first vertical direction into the outlet-closed position in response to rotation of the pinion in the one direction of rotation.

2. The air conditioner according to claim 1 wherein the axle is slidable in a guide slot when the pinion is moved between meshing engagement with the first and second racks.

3. The air conditioner according to claim 1 wherein each rack includes a tripping jaw arranged to engage and displace the pinion toward the other rack at the end of each vertical stroke of a rack.

4. The air conditioner according to claim 1 further including a device connected to the pinion for shifting the pinion between engagement with the first and second racks.

5. The air conditioner according to claim 4 wherein the motor is mounted in a shiftable element, the device connected to the element for shifting the motor, axle, and pinion.

6. The air conditioner according to claim 5 wherein the element is pivotably mounted for rotation about a fixed axis.

7. The air conditioner according to claim 4 wherein the device is a fluid actuated cylinder.

* * * * *